US005590954A

United States Patent [19]

Hanson et al.

[11] Patent Number: 5,590,954

[45] Date of Patent: Jan. 7, 1997

[54] DIMMER BLADE

[75] Inventors: Douglas A. Hanson, Arlington; Timothy D. Stacy, Plano, both of Tex.

[73] Assignee: Vari-Lite, Inc., Dallas, Tex.

[21] Appl. No.: 259,998

[22] Filed: Jun. 15, 1994

[51] Int. Cl.[6] ..... F21V 49/021

[52] U.S. Cl. ..... 362/321; 362/280; 362/351

[58] Field of Search ..... 362/280, 282, 362/284, 319, 321, 322, 323, 324, 351, 281

[56] References Cited

U.S. PATENT DOCUMENTS 1,591,211 7/1926 Brenkert et al. ..... 362/281

3,016,454 1/1962 Simms ..... 362/321

4,425,599 1/1984 Rieder et al. ..... 362/319

*Primary Examiner*—Denise L. Gromada

*Assistant Examiner*—Y. Quach

*Attorney, Agent, or Firm*—Morgan & Finnegan, L.L.P.

[57] ABSTRACT

A nonplanar mechanical dimmer for use in a variable parameter luminaire includes claws, a mounting region and a convex beam blocking region which does not reflect energy back onto a light source during dimming.

14 Claims, 6 Drawing Sheets

DIMMER BLADE

TECHNICAL FIELD OF THE INVENTION

The present invention relates to lighting instruments, and especially to mechanical dimmers used in theatrical luminaires.

BACKGROUND OF THE INVENTION

The art of theatrical illumination has been greatly advanced in the recent past. In addition to well-known wash (or general area) lights and spot lights, recent systems have been devised in which many parameters of a light beam projected by a luminaire can be varied by remote control, including the orientation of the luminaire with respect to pan and tilt, and the diameter, shape, divergence, color and intensity of the beam. Bornhorst U.S. Pat. No. 4,392,187 describes a system which has been found to work well in actual practice. A specialized type of theatrical luminaire capable of projecting an image on a stage screen or backdrop is described in Bornhorst U.S. Pat. No. 4,779,176. While standard wash and flood lights are typically provided with parabolic or spherical reflectors, projection type luminaires are increasingly being provided with ellipsoidal reflectors. In all the discussed types of modern theatrical luminaires, and especially with respect to automated luminaires with pan and tilt heads, a consistent design goal has been to decrease luminaire size and weight while increasing the number of functions which can be performed and the mobility of the lighting instrument itself.

An important parameter for all luminaires is light intensity. While acceptable known systems have used electronic means of varying light beam intensity, mechanical means of varying intensity (or dimming) are often preferable. At least three major types of mechanical dimming apparatus are known: irises, shutters and blades. Unfortunately, none of the mechanical dimmer systems is entirely acceptable.

Iris dimmers are typically composed of a plurality of curved, opaque elements, or leaves, carried in two concentric and intermeshing rings. The iris is operable to vary the diameter of an aperture formed by the inner edges of the leaves. As the rings rotate, the leaves pivot about pins which secure each end of each leaf to one or the other of the two rings, such that each leaf is secured to one ring at one end and to the other ring at the other end. As the diameter of the aperture decreases, the amount of light which can be projected through the iris is diminished. Brenkert U.S. Pat. No. 1,591,211 describes a typical iris dimmer in a theatrical luminaire.

However, several difficulties arise from use of an iris dimmer. The iris must not be located at or near a focal point of an optical system, for example in the projection gate of an ellipsoidal spot light projector, or the inner edges of the iris leaves will be projected as an image. Even when located away from a focal point, operation of the iris affects the depth-of-focus of the optical system. As the iris aperture is made smaller, the depth-of-focus increases so that an image formed in the aforementioned projection gate is brought into focus even if prior adjustment of a projection lens included in the optical system has made the image out-of-focus.

Moreover, iris dimmers are complex in terms of the number of moving parts, the tolerances required for the dimmer to function and the actuator or other driving linkages. In addition because an iris dimmer typically may not be fully closed, additional equipment to fully block the light beam is often required.

Another class of dimming apparatus known in the prior art is shutter dimmers. Shutter dimmers are typically composed of a plurality of generally straight, opaque elements arranged either in side-by-side fashion transversely across a light beam path or in a radial fashion extending from a hub in the center of a light beam path to a point on the periphery of the path. The shutter is operable to vary the spacing between the edges of the shutter elements. Each element pivots in coordination with all other elements to obstruct the projection of light rays by an optical system and thereby control the intensity of a projected beam. Steel U.S. Pat. No. 3,333,094 depicts the general characteristics of shutter dimmers.

Shutter type dimmers offer means to avoid the design difficulties encountered with iris dimmers. Shutter dimmers are simpler to construct than iris dimmers, and induce no effect upon the depth of focus of the optical system. Shutter dimmers are frequently used in optical systems having parabolic or spherical dish reflectors, for example floodlights and searchlights, which project no image. In systems capable of projecting an image, shutters may be disadvantageous because the shutter elements tend to redirect portions of a light beam incident thereupon as the elements move through intermediate positions between fully open and fully closed. This result may be effectively countered by: 1) using non-specular elements, for example elements painted a non-reflective black; 2) using smaller elements, although more such elements are required; 3) employing a radial arrangement of shutter elements such that portions of the beam are reflected in different directions; 4) providing baffles around the shutter or even enclosing the shutter within a housing containing a lamp and reflector; or any combination of the aforementioned techniques.

However, the known methods by which the disadvantages of shutter dimmers may be overcome are themselves disadvantageous when attempting to construct a modem motorized luminaire in which small size, light weight and quick maneuverability using the smallest possible motors are the primary design criteria. For example, extra baffles and housings increase both the size and weight of the luminaire. In addition, increasing the complexity of the shutter increases cost and construction difficulties so as to negate the desired advantages over an iris dimmer design.

A third type of dimmer known to those of skill in the art is a blade dimmer. A blade dimmer is composed of an opaque element, or blade, which is introduced into a light beam path to reduce the intensity of the projected beam. In operation, the blade may enter the beam path via motion along a track or guide, or through arcuate motion about a pivot point adjacent to the light beam path. Although dual-blade dimmers are known, generally a blade dimmer has only one moving part consisting of the blade coupled to an actuator, as contrasted with the plurality of elements commonly required for an iris dimmer or a shutter dimmer. The blade may have a straight leading edge which first enters the light beam path, but such a construction disadvantageously tends to dim one side of the projected beam more than the other as the blade is rotated into the beam path. For this reason, blade dimmers often feature serrated, ragged, or severely spiked leading edges, so that the dimming effect is less noticeably asymmetrical.

Blade dimmers are capable of providing several advantages over iris and shutter dimmers. A blade dimmer is significantly simpler to construct than a shutter dimmer, having only the one moving part. Full-field dimming is more difficult to accomplish, however, requiring a complex shape of the leading edge of the blade. The simplicity of the resulting mechanism offers sufficient utility to offset the difficulty of fabricating the blade. And, like the shutter dimmer, the blade dimmer presents no problems affecting the depth of focus of an optical system.

Nonetheless, prior art blade dimmers leave much to be desired. For example, in a typical spot light projector for entertainment lighting, having an arc-lamp light source optically coupled to an ellipsoidal reflector and one or more projection lenses, a blade dimmer must be reflective to avoid deterioration due to heat absorption. The arc lamp of such a system is positioned at a first focal point within the reflector such that light rays emanating from the lamp will converge upon a second focal point at which a projection gate is located. Depending upon the placement of the blade, the reflected light rays tend to converge upon a third focal point where a partial image of the arc light source is formed. When the blade fully intercepts the beam, all of the reflected light rays will converge upon the third focal point. This third focal point may occur anywhere along the beam path between the blade and the reflector, at the periphery of the transparent envelope surrounding the arc light source, or even at a front seal of the envelope, where excessive overheating and subsequent premature failure of the lamp may result. This unsatisfactory result is even more serious in the temperature and space constrained environment of a modern motorized luminaire with a pan and tilt head. In such a device, axial beam path space and weight are necessarily severely constrained.

A blade dimmer may be tilted with respect to the beam so that reflected light is not returned to the light source but is reflected into a side housing. However, sufficient angling of the blade to achieve the desired result requires much more axial beam path for the dimmer assembly and so is an undesirable solution in a compact, lightweight luminaire.

Although there are several types of mechanical dimmers known to the art, none is fully acceptable for use in a modern theatrical luminaire. A need exists for a new mechanical dimmer which provides a simpler construction and is lighter and smaller than the known mechanical dimmers. An acceptable mechanical dimmer must use the least possible axial beam path space and be able to be rotated quickly to provide a continuous range of dimming from slight through complete reduction of the intensity of the projected beam.

It is an object of the present invention to provide a blade dimmer which avoids destructive reflection of the blocked light beam.

It is another object of this invention to provide a blade dimmer which is adapted for use in a high heat environment modern motorized pan and tilt luminaire.

It is still another object of the present invention to provide a blade dimmer adapted to a modern theatrical luminaire which diffuses the reflected beam with minimal induced vibration due to imbalance of the blade when in operation.

SUMMARY OF THE INVENTION

A dimmer blade of the present invention comprises a suitably configured leading edge and single or multiple convex surfaces arranged in or on the area of the blade which fully intercepts an incident light beam. The blade may be driven to a continuous range of positions between no dimming no beam intercept and full dimming full beam intercept.

BRIEF DESCRIPTION OF THE DRAWINGS

The present invention and its advantages may be clearly understood by referring to the following detailed description and the accompanying drawings, of which.

DETAILED DESCRIPTION OF THE INVENTION

Figure 1:
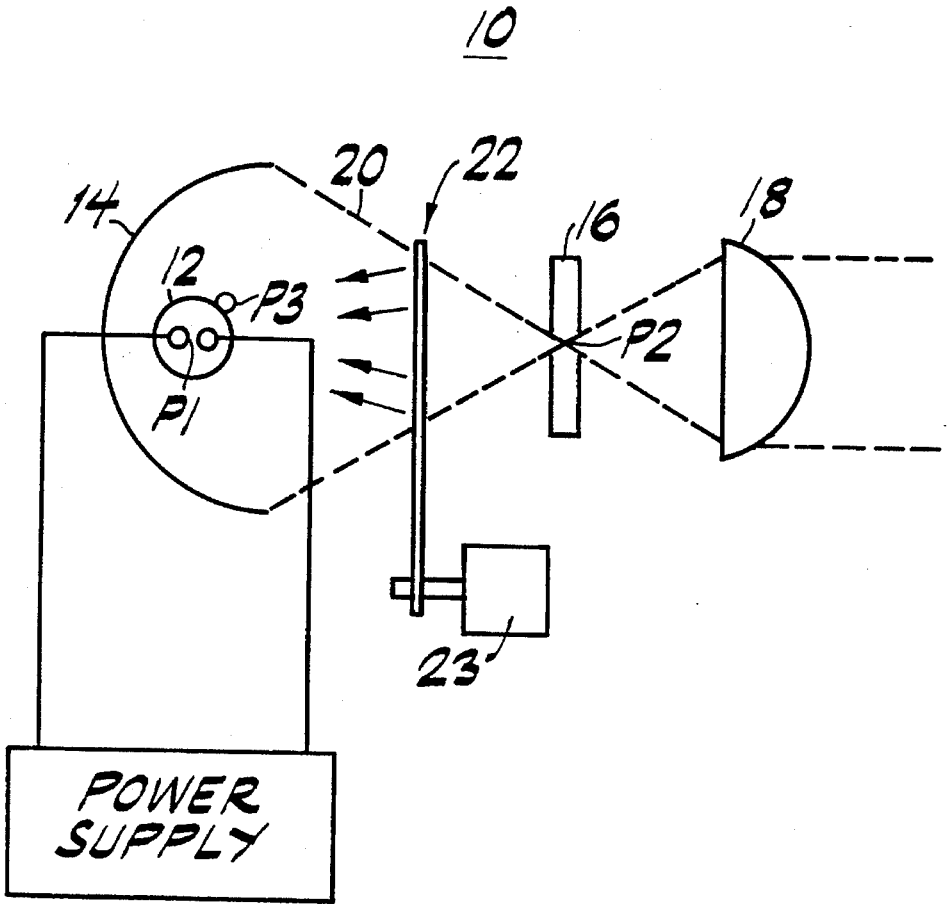
FIG. 1 Prior Art
FIG. 1 is a block diagram of a prior art optical system.

In accordance with prior art practice, as shown in FIG. 1, a generic optical system 10 comprised of a light source 12, a reflector 14, a projection gate 16 and a projection lens 18 has a first focal point P1 and a second focal point P2. The light source 12 is located at point P1, the location of which is defined by the shape of reflector 14. The light source 12 and reflector 14 cooperate to form a light beam 20, which converges upon point P2 and diverges thereafter until the beam strikes and is projected by lens 18. The projection gate 16 is located at point P2, the location of which is also defined by the shape of reflector 14. A light pattern generator, such as a photographic slide or metal stencil, when placed in the projection gate forms an image, which is projected by the optical system 10.

To control the light output intensity, a dimmer blade 22 is located between points P1 and P2. Dimmer blade 22 is mounted to the shaft of a suitable actuator, such as motor 23, which is operable to effect arcuate motion of the blade 22 about a pivot point adjacent to the beam, the motion being in a plane transverse to the beam. As found in the prior art, dimmer blade 22 is a flat piece of reflective metal, such as steel or aluminum. When the dimmer blade is moved to fully intercept the light beam, the reflective metal blade completely reflects the light beam, which then converges upon an alternate focal point P3. This concentrates the light energy reflected back towards the source and, in the worst case, focuses the reflected image of the source upon the transparent envelope of the source causing accelerated deterioration and premature failure thereof.

Figure 3:
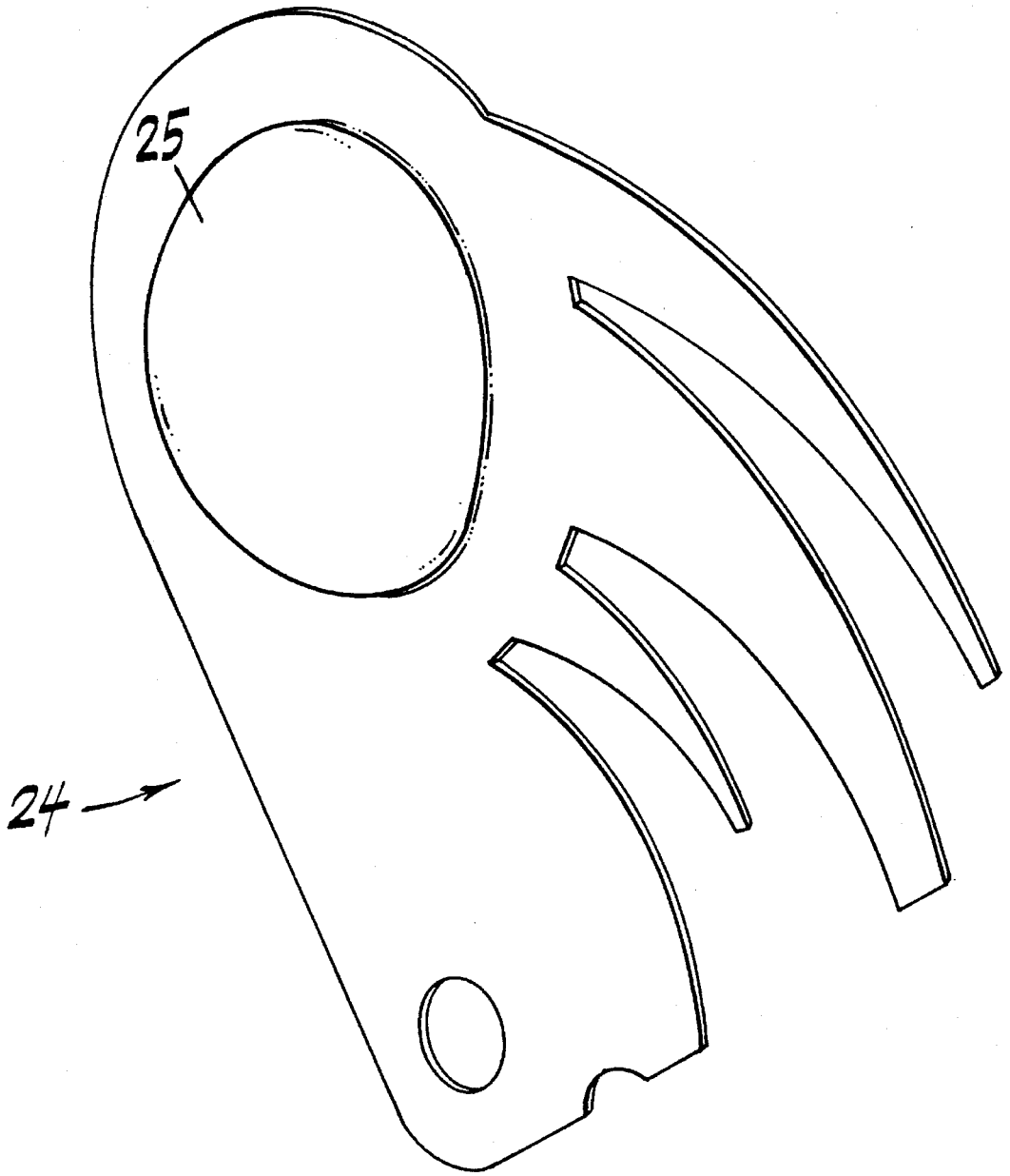
FIG. 3 is a perspective view of a dimmer blade embodiment depicted in the system of FIG. 2.

As shown in FIG. 3, one embodiment of the present invention's dimmer blade 24 has a protruding convex surface, in the shape of a dome 25, formed in or on the otherwise flat metal blade. It will be appreciated that the protruding surface may be a simple surface, such as the surface of a regular geometric solid. More complex convex surfaces, including irregular solids or various combinations or sections of regular and irregular solid surfaces, may also be chosen for use in this area or region of the blade.

Leading edge claws are also depicted in FIG. 3, and their size and shape may be selected by one of skill in the art. Experience has shown that the number and shape of the claws should be selected so that the fraction of the beam blocked is roughly equivalent to the fraction of total travel of the blade at any given moment. For example, it is advantageous to block approximately ¼ of the beam when the blade has rotated ¼ of its range, to block approximately ½ of the beam at the halfway point of rotation, etc. In operation, as the blade pivots on its mount, traveling arcuately into the light beam path, the leading edge claws reach into the beam, offering the appearance of obstructing light rays from the center and both sides of the beam throughout most of the blade's range of travel. The blade dimmer of this invention may also be operated to provide both smooth fades and rapid strobe effects.

Figure 2:
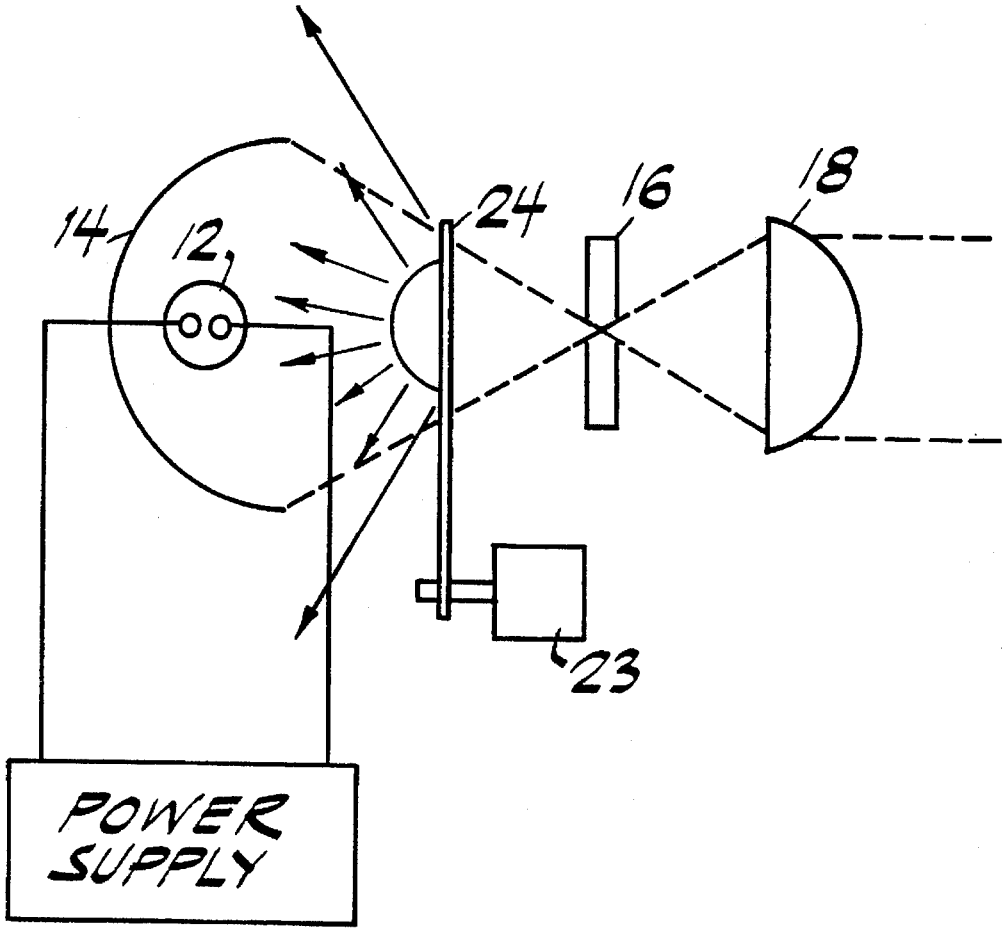
FIG. 2 is a block diagram of an optical system in accordance with the present invention.

As shown in FIG. 2, when the dimmer has rotated to fully intercept the beam, a nonplanar domed convex dimmer blade embodiment causes the reflected light beam to diverge greatly so that substantially no image of the light source is formed. While the depicted embodiment is effective in larger or stationary luminaires, it is not optimally suited for use in a compact, low weight motorized pan and tilt luminaire. For example, a convex domed dimmer may require more space for clearance between the dimmer blade and other components of the optical system than does a substantially flat blade. Also, if the center of gravity of the blade lies in a plane too far offset from the plane of the blade itself as a result of the size, height and density of the convex surface, rapid motion tends to bend or flex the blade. Moreover, if the dimmer is operated at or near its resonant frequency, very large oscillations can occur creating undesirable noise due to vibration of the blade, thereby rendering the blade unusable.

Figure 4:
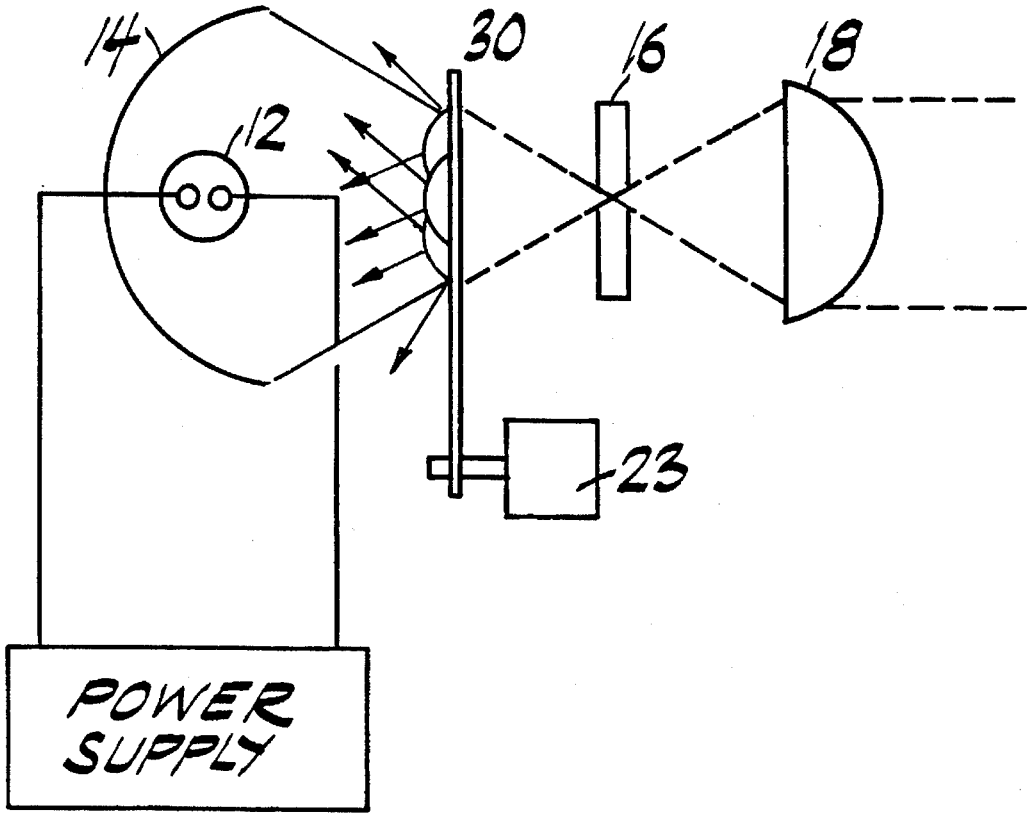
FIG. 4 is a block diagram of a preferred optical system in accordance with the present invention.
Figure 5:
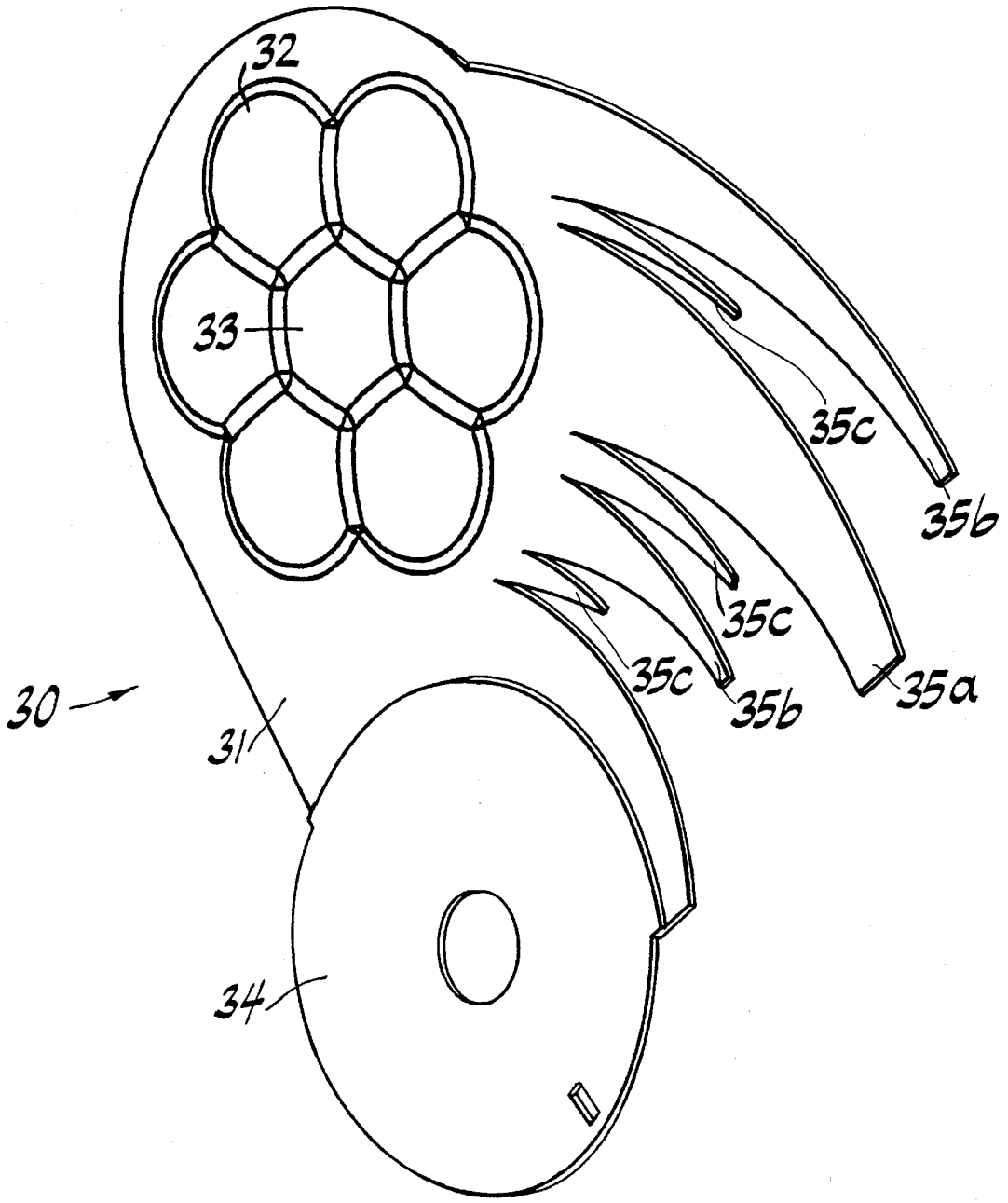
FIG. 5 is a perspective view of a preferred dimmer blade according to the present invention.

In accordance with a preferred embodiment of the present invention, and as shown in FIGS. 4 and 5, a dimmer blade 30 has multiple convex surfaces formed in or on the metal surface. The center leading edge claw 35A is longer and wider than the outside leading edge claws 35B to enhance the appearance that the beam intensity is uniformly decreased throughout the continuous interception arc of the blade's travel. Secondary claws 35C further enhance the appearance of uniform dimming as the blade 30 moves to fully intercept the beam, providing a less abrupt transition from a state of some light intensity to zero intensity output.

Figure 6A:
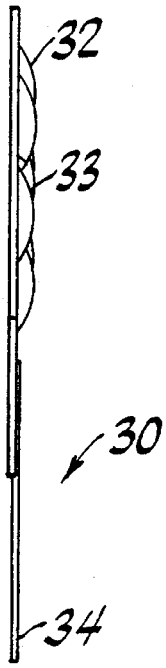
FIGS. 6A, 6B, and 6C are orthographic views of a preferred dimmer blade according to the present invention.
Figure 6B:
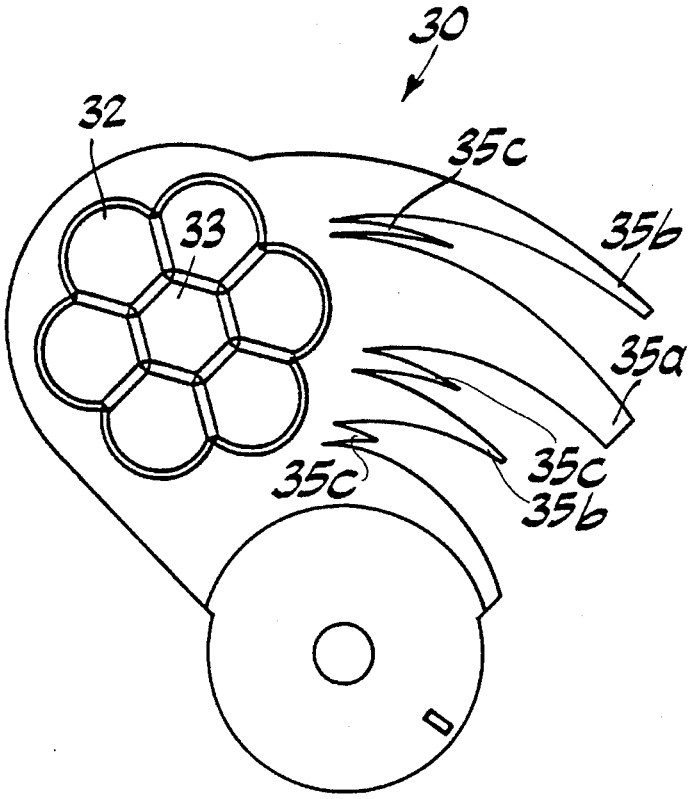
Figure 6C:
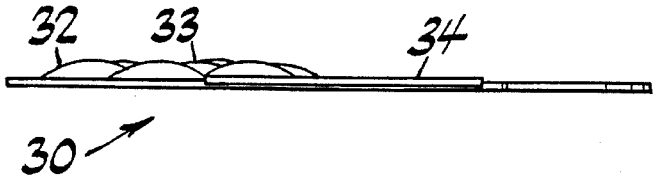

An especially preferred embodiment shown in FIGS. 6A, 6B and 6C includes six small dimples 32 arranged in a circular pattern around a central dimple 33, as well as the primary and secondary claws 35A, 35B, and 35C.

The multiple dimples serve to reflect a converging incident light beam as multiple small diverging and commingling light beams. The height of the dimples above the blade face may be kept small, with the advantageous result that the center of gravity of the blade is not far offset from the plane of the blade. To compensate for the change in center of gravity resulting from the dimples of the preferred embodiment, a circular mounting region 34 is offset from the plane of the blade in the same direction as the dimples, that is toward the light source, although not as far as the dimples. As may be seen in FIG. 6C, three distinct planes are thus defined. This locates the plane of the mounting region 34 closer to the center of gravity of the dimmer blade and thereby avoids instability problems. One of skill in the art will be able to adjust the offset of the mounting area, or adopt other standard fabrication techniques, to similarly avoid blade instability in other embodiments of the invention.

The present invention also contemplates applications other than stage lighting. For example, a lighting apparatus intended to compliment a building or other display, such as an architectural luminaire, can be constructed using the foregoing techniques.

It will be understood that the present invention is not limited to the embodiments disclosed, but is capable of rearrangements, modifications, substitution of equivalent pans and elements without departing from the spirit of the invention as defined in the following claims:

What is claimed is:

1. An intensity control device for a luminaire comprising:

an opaque dimmer blade having a first flat region defining a first plane;

a plurality of convex surfaces formed in said first flat region, the apexes of said convex surfaces defining a second plane, and;

a second flat region associated with said first flat region defining a third plane located between said first and second planes; said device further comprising a mounting region in said second flat region.

2. The intensity control device of claim 1 wherein said convex surfaces are arranged in a regular geometric pattern.

3. A dimmer blade for controlling the intensity of a projected light beam comprising:

a single integral nonplanar dimmer blade body;

a plurality of leading edge claws associated with said blade body intercepting selected portions of the light beam;

a protruding full beam intercepting region formed on said blade body for blocking the entire light beam without destructively reflecting the blocked beam; and a mounting region associated with said blade body having a mounting site adapted to receive a rotative force and transmit that force to the blade body, whereby the blade may be rotated through a continuous arc of interception of the light beam.

4. The dimmer blade of claim 3 wherein said mounting region is offset from a plane of the claws and the protruding full beam intercepting region to provide rotational stability.

5. The dimmer blade of claim 3 wherein said leading edge claws are adapted to block a portion of the light beam substantially equal to a portion of a continuous arc through which the dimmer blade has been rotated.

6. The dimmer blade of claim 3 wherein said protruding full beam intercepting region is a simple dome like convex surface.

7. The dimmer blade of claim 3 wherein said protruding full beam intercepting region is a complex convex surface.

8. The dimmer blade of claim 3 wherein said protruding full beam intercepting region is comprised of a plurality of convex surfaces.

9. The dimmer blade of claim 3 wherein said protruding full beam intercepting region comprises a plurality of convex surfaces arranged in a geometric pattern.

10. A theatrical projection luminaire comprising:

a high intensity light source;

a reflector capable of projecting a beam created from light emanating from the light source;

a nonplanar motor actuated mechanical dimmer blade capable of rotatably intercepting the light beam through a continuous range of positions ranging from zero interception to complete interception, said dimmer blade further comprising, leading edge claws for initially intercepting the light beam, said claws of said dimmer blade adapted to intercept several discrete portions of said light beam, a convex full beam intercepting area formed on said dimmer blade capable of entirely blocking the light beam without destructively reflecting the light blocked;

a pivot mounting associated with said dimmer blade positioned outside the light beam about which the dimmer blade may be rotated through its full range of intercepting motion;

a projection gate for receiver said light beam; and a lens for projecting said light beam.

11. The luminaire of claim 10 wherein the convex full beam intercepting area is a simple geometric dome like surface.

12. The luminaire of claim 10 wherein the dimmer blade convex full beam intercepting area is a complex combination of several convex surfaces.

13. The luminaire of claim 12 wherein the convex surfaces are arranged in a regular geometric pattern.

14. The luminaire of claim 10 wherein the convex full beam intercepting area comprises a surface of an irregular solid.

* * * * *